US008820441B2

(12) United States Patent
Shamburger

(10) Patent No.: US 8,820,441 B2
(45) Date of Patent: Sep. 2, 2014

(54) COMBINATION CORING BIT AND DRILL BIT USING FIXED CUTTER PDC CUTTERS

(75) Inventor: James Shamburger, Spring, TX (US)

(73) Assignee: Tercel IP Ltd., Kingston Chambers, Road Town (VG)

( * ) Notice: Subject to any disclaimer, the term of this patent is extended or adjusted under 35 U.S.C. 154(b) by 542 days.

(21) Appl. No.: 12/288,888

(22) Filed: Oct. 24, 2008

(65) Prior Publication Data

US 2010/0101870 A1 Apr. 29, 2010

(51) Int. Cl.
*E21B 10/02* (2006.01)
*E21B 10/04* (2006.01)
*E21B 10/48* (2006.01)

(52) U.S. Cl.
USPC ..... 175/403; 175/404; 175/405.1

(58) Field of Classification Search
USPC ..... 175/403, 404, 405.1, 434
See application file for complete search history.

(56) References Cited

U.S. PATENT DOCUMENTS

| | | | | |
|---|---|---|---|---|
| 2,731,236 | A * | 1/1956 | Floyd | 175/405.1 |
| 3,100,544 | A | 8/1963 | Overly et al. | |
| 3,599,736 | A * | 8/1971 | Thompson | 175/434 |
| 3,640,355 | A * | 2/1972 | Lebourg | 175/430 |
| 4,207,954 | A * | 6/1980 | Jerome | 175/405.1 |
| 4,527,644 | A * | 7/1985 | Allam | 175/333 |
| 4,558,753 | A * | 12/1985 | Barr | 175/431 |
| 5,467,836 | A | 11/1995 | Grimes et al. | |
| 5,655,614 | A * | 8/1997 | Azar | 175/404 |
| 5,695,019 | A * | 12/1997 | Shamburger, Jr. | 175/333 |
| 7,278,499 | B2 * | 10/2007 | Richert et al. | 175/348 |
| 7,954,571 | B2 * | 6/2011 | McClain et al. | 175/431 |
| 2007/0215389 | A1 * | 9/2007 | Da Silva et al. | 175/331 |

* cited by examiner

*Primary Examiner* — Shane Bomar
*Assistant Examiner* — Wei Wang

(57) ABSTRACT

A drill bit having fixed Polycrystalline Diamond Compact cutters is used to drill a borehole having a core stump therein. A plurality of additional fixed Polycrystalline Diamond Compact cutters are disposed in the dome of the bit and are usable to concentrate stresses in the top end of the core stump to facilitate the cutting down of the core stump.

17 Claims, 9 Drawing Sheets

COMBINATION CORING BIT AND DRILL BIT USING FIXED CUTTER PDC CUTTERS

FIELD OF THE INVENTION

This invention relates generally to the use of coring bit technology in combination with a drill bit used for drilling an earth borehole, and more particularly, to a combination coring bit and drill bit using fixed cutter PDC cutters for both functions.

PRIOR ART

It is known in the art of drilling earth boreholes to combine the features of a rotary cone drill bit with a dome area cutter insert, for example, as described in U.S. Pat. No. 5,695,019 to James M. Shamburger, Jr. which issued on Dec. 9, 1997.

In the field of exploration and production of oil and gas, one type of drill bit, sometimes referred to as a rock bit, is used for drilling earth boreholes and is commonly known as a rotary cone drill bit. The typical rotary cone drill bit employs a multiplicity of rolling cone cutters rotatably mounted to extend downwardly and inwardly with respect to the central access of the drill bit. Typically, the rolling cone cutters may have milled teeth or cutter inserts disposed on each cutter in predefined patterns. The predefined teeth or insert pattern of each rolling cone cutter are typically different from one another so that the teeth or inserts of the cone cutters mesh as the cone cutters are rotated. In constructed in this manner, the teeth are inserts located on the conical sides of the cutter do not create grooves in the borehole. Further, the meshing rotating teeth or inserts on the conical sides is capable of contacting and cutting the entire bottom of the borehole.

Although the typical rotary cone drill bit has been the tool of choice for drilling earth boreholes, several undesirable phenomenon affects the efficiency and performance of the bit. It should be noted that the teeth or inserts located at or near the conical tips of the rolling cone cutters mesh and cut the center of the borehole. Because of the rotary cone drill bit configuration, the rotation of the conical tips of the rolling cone cutters travels the least amount of distance. Indeed, certain teeth or inserts may remain substantially stationary but for the rotational movement. Because the amount of cutting is directly related to the movement of the teeth or inserts, it is a poor translation of rotation energy to the cutting structures which generate little rock removal. Therefore the center of the well bore present a special challenge to the progress of the drilling.

Typically, one measure of the rotary cone drill bits performance is its ability to maintain a consistent borehole diameter. This ability to hold gauge is important to enable drill strings to be easily removed from and inserted into the borehole. Gauge holding is particularly important for directional drilling applications. A further disadvantage associated with typical rotary cone drill bits is the tendency for the conical cutters to cut under-gauge. As the drill bit advances, the rock formation tends to pinch or force the rolling cone cutters and the support arms inwardly. The results in a borehole that is under-gauge.

It was one of the primary objects of the invention disclosed in the aforementioned U.S. Pat. No. 5,695,019 to eliminate the pinching effect which would otherwise cause the rolling cone cutters and the support arms inwardly.

To overcome the pinching effect, U.S. Pat. No. 5,695,019 introduced the concept of using a coring device to create a central core in the center of the borehole which prevents the rotary cones from being pinched in the drilling process. However, the core produced in U.S. Pat. No. 5,695,019 had a really small diameter, some 0.25 inches to 1.0 inches, and would tend to fall down on their own, a concept having no particular relevance to the present invention.

In sharp contrast, the present invention provides a bit design which is based on utilizing the concept of coring as part of the drilling process. By drilling a core and then destroying the core once it is freestanding in the bottom of the hole, the stress concentrations within the core stump shape make the core more susceptible to rupture, and thus increased drilling performance in harder rock formations.

Traditionally, roller cone rock bits have been used to drill the very hard formations, essentially to the exclusion of using PDC cutters in such formations. By being able to destroy the core formed in the center of the borehole, the PDC cutters can be used to drill in very hard rock in accordance with the present invention.

In order to form a core, the outer diameter of the well bore must be drilled first. The outermost portions of the bit profile are designed similar in profile to a standard PDC core head, with both inner and outer vertical gauge sections and inner and outer gauge reliefs. The inner gauge relief allows for the core stump to stand free of support by the leading cutting structure. Blades are used to position the cutters with a core-head like terminus, as illustrated hereinafter, or thicker lug-like protuberances as are also illustrated hereinafter. In both examples, the common coring profile is exhibited where the outer portion of the borehole is drilled first. Embodiments of the drill bits shown in FIGS. 1D, 2A, and 2B, depict the inner gauge relief 31 as a channel (e.g. a groove, recess, etc.).

Distil to the core/gauge section and above the inner gauge relief, traditional blade structures having PDC cutters are used in the interior of the bit to drill up the core stump. Since the profile being specified herein grossly resembles that of a roller cone bit, those skilled in the art will sometimes refer to the cutters which eradicate the core stump as "dome cutters" or "dome blades." These structures can be concave, flat or convex, or any other profile which lends itself to eradicating the core stump. The leading edge of the cutting structure is the core-head like terminus of the blades or lugs, which create the core stump, whose form concentrates residual stress in the upper 360° peripheral top end of the stump. The inner core stump is drilled by the dome blades and associate cutters must take advantage of and even increase residual stresses to further concentrate them and initiate formation rupture at lower energy levels.

Due to the length and the intricate shape of the blades having the PDC cutters required to execute this profile, steel might seem to be an obvious choice for body material. However, in very abrasive formations, steel is problematic in that it wears rapidly. Tungsten carbide is the norm for abrasive elements but its brittle nature doesn't lend itself to thinner, more delicate designs.

In very abrasive environments, such as sharp sands and quartzite, for example, there are relatively few young, reactive shales or clays to cause bit balling. Thus, one can do with reduced junk slot volumes and still drill efficiently. In order to facilitate matrix construction, carbide matrix material is used to connect the blades at key points reinforcing the longer blades required for this profile by interconnecting them. Thus, reinforcing joints are formed to create a sort of "webbing" or "ring" to connect the thinner blades and add strength to a more brittle material.

An additional feature of the present invention involves the use of a core-head like profile as the nose of the bit, thus effectively locking the cutting structure into the bottom hole pattern, disallowing strong lateral movement and minimizing the effects of drill string vibrations. The core stump provides a great degree of lateral stability, disallowing large lateral movement. By employing a self-stabilizing cutting structure on the core/gauge terminus of the blades a very stable bit is created. This is effectively the "tool rest" for the PDC cutters, and thus they are in more of a "formation milling" mode of operation that an engrossed, less stabilized drilling mode traditionally associated with typical PDC cutter designs. This results in a longer lasting PDC cutter and reduced PDC cutter chipping.

From a directional standpoint, the bit in accordance with the present invention is very difficult to move laterally, which makes it have very stable directionally. For the bit to move laterally, one has to essentially break the core stump off. Thus it is very likely that this bit will maintain any angle built into the well very effectively. It also tends to resist following a fault or similar change in dispositional planes.

By concentrating residual rock stresses in the periphery of the core stump, the amount of energy required to rupture the rock is reduced, providing a more efficient and faster drilling bit. As an optional design modification, a frustum can be formed in the center of the bit, and thus be made to increase the residual stress in the bottom of the hole. These optional design modifications may include a series of steps, waves, ridges or any other geometric shape inherent in the bottom hole pattern which concentrates stress and weakens the rock.

Additional modifications can be made or created on a smaller scale by cutter placement. By placing cutters in a highly redundant fashion (identical Y position with respect to midline) and closely adjacent to each other a very heavily scalloped bottom hole profile is created. The scalloped bottom hole pattern induces additional stresses in the native rock, further weakening the rock. Saw tooth and other obvious patterns can be built into the design in similar fashion.

Obviously as additional options, different cutter shapes can be employed to develop stresses, such as a pointed cutter adjacent to a round cutter. An elliptical cutter next to a round cutter, or cutters set at varying heights which provide obvious alternatives to develop stresses in the rock. Even different size round cutters placed adjacently will develop stress risers which weaken formation strength and promote rupture of the rock.

Thus, the combination of the gross profile of the design and the optional cutting structure patterns, or cutter geometry modifications will result in a drill bit that significantly weakens the end-situ rock strength and will promote formation rupture at lower energy levels, resulting in a more rapid removal of formation when drilling very hard rock.

DETAILED DESCRIPTION OF THE PREFERRED EMBODIMENT OF THE INVENTION

Figure 1A:
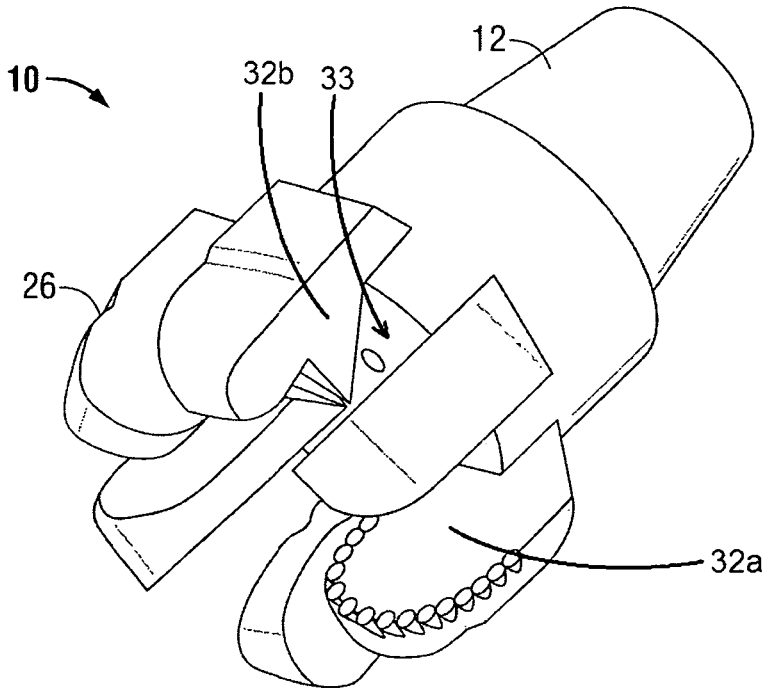
FIG. 1A is an elevated, isometric, pictorial view of a six bladed drill bit according to the invention.
Figure 1B:
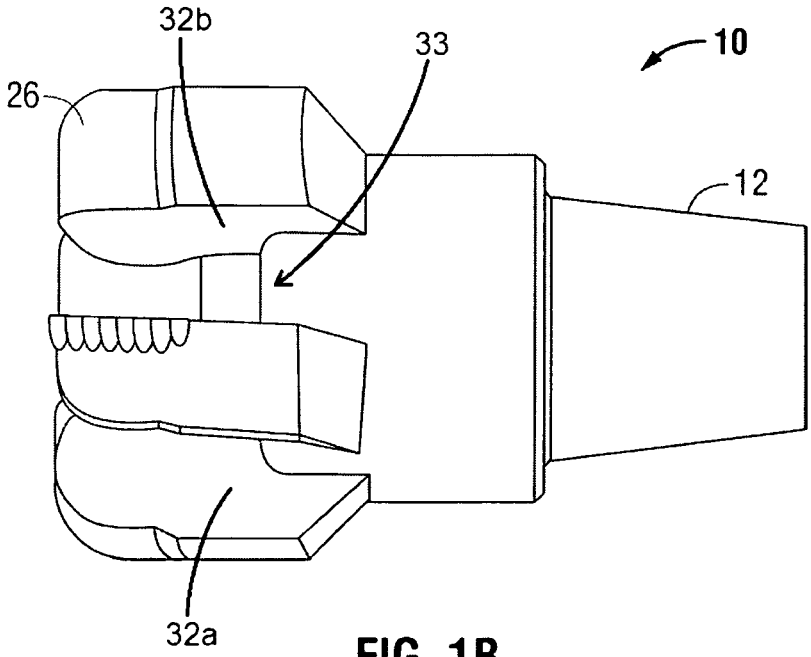
FIG. 1B is a side view of the drill bit according to FIG. 1A.

Referring now to the drawings in more detail, FIGS. 1A, 1B, 1C and 1D illustrate a drill bit 10 having a threaded pin end 12 which can be threaded into the box end of a joint of drill pipe (not illustrated). Each of the blades 14, 16, 18, 20, 22 and 24 has its own wear gauge pad 26. Each of the blades is further shown comprising a side surface 32*a* and 32*b*, which defines an open space or a channel 33 therebetween.

Each of the blades has a row of PDC cutters 28. It should appreciated that for each of the blades, the row of PDC cutters 28 starts off from the wear pad 26, as best illustrated in FIG. 1D. The rotation of the bit causes the u-shape portion of the row of PDC cutters to drill around what ends up being the core which is uncut until later when the PDC cutters in the relief portion 30 cause the core stump to disintegrate and be drilled out. The PDC cutters in the relief section is identified by the numeral 29. The relief section cutters 29 are also illustrated in FIG. 1C. As will be described hereinafter in greater detail, the core stump is first formed by the action of the PDC cutters 28 and after the core is formed, the PDC cutters 29 will cause stress forces to be formed around the lower periphery of the stump which will then enable the cutters to 29 to drill more easily through the stump. Before being drilled out by the dome cutters 29, the core at its top end will always have a diameter greater than 1.0 inches, and will typically have diameters at the top end of the core in the range of 2.0 to 7.0 inches.

Figure 1C:
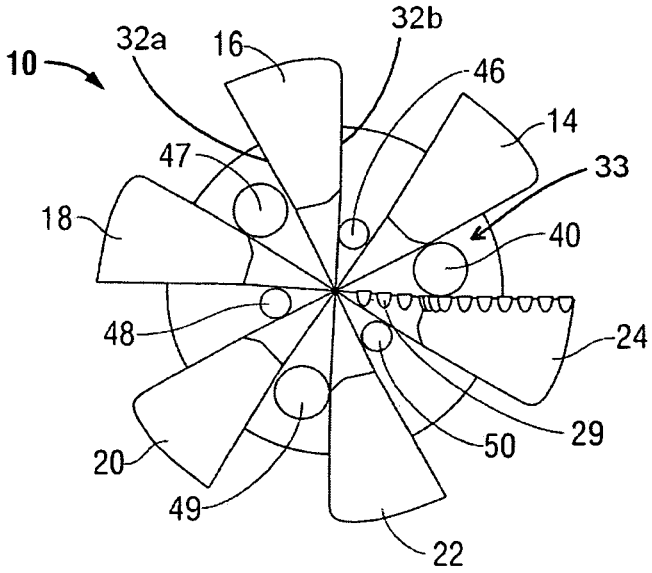
FIG. 1C is a bottom end view of the drill bit according to FIG. 1A.
Figure 1D:
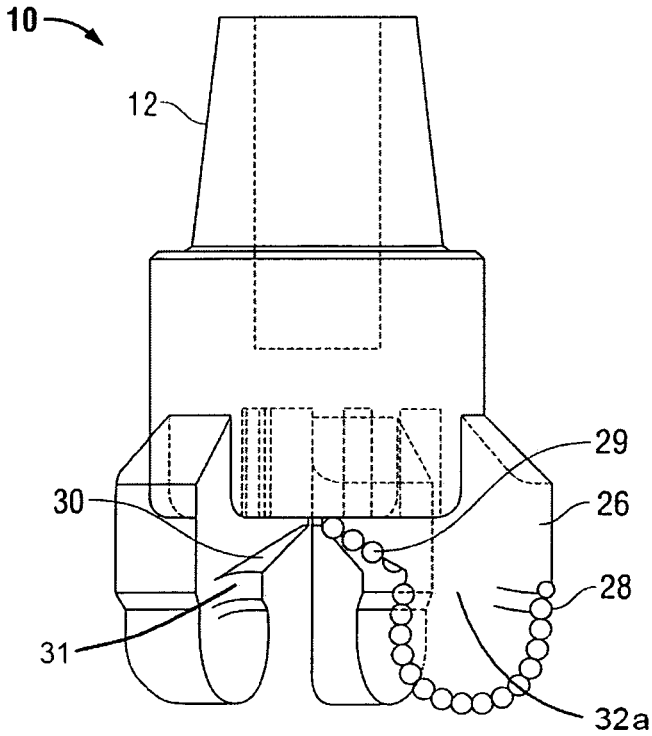
FIG. 1D is an elevated view, partly in cross-section, of the drill bit according to FIG. 1A.

As illustrated in FIG. 1C, the drill bit 10 according the present invention, illustrated in FIG. 1A has a plurality of nozzles, a first set of three larger nozzles 40, 47 and 49 and three smaller nozzles 46, 48 and 50 which cause the drilling fluid to exit around the PDC cutters 29 in the relief surface 30.

Figure 2A:
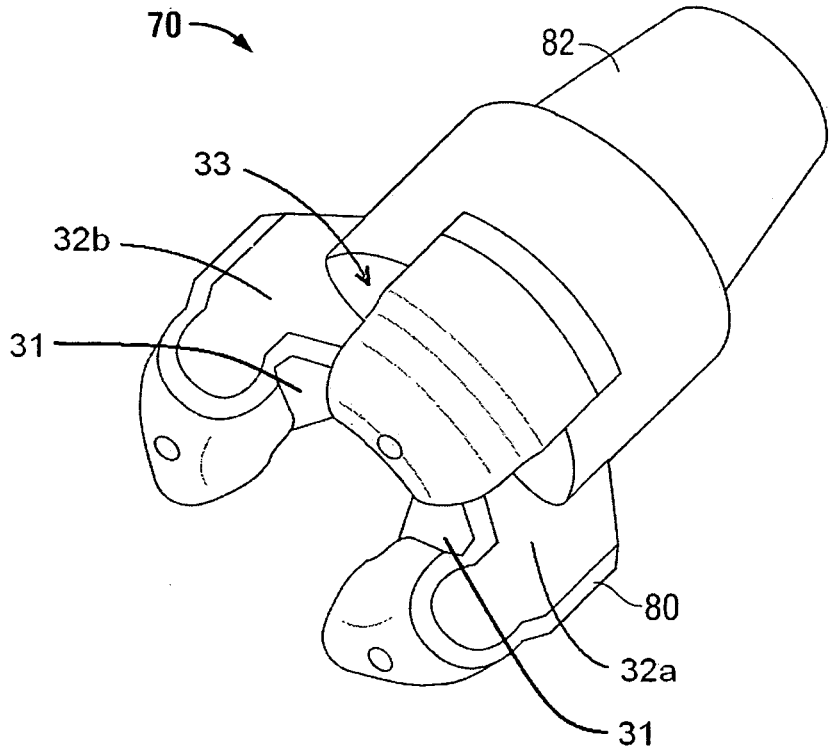
FIG. 2A is an elevated, isometric, pictorial view of a three leg drill bit according to the invention.
Figure 2B:
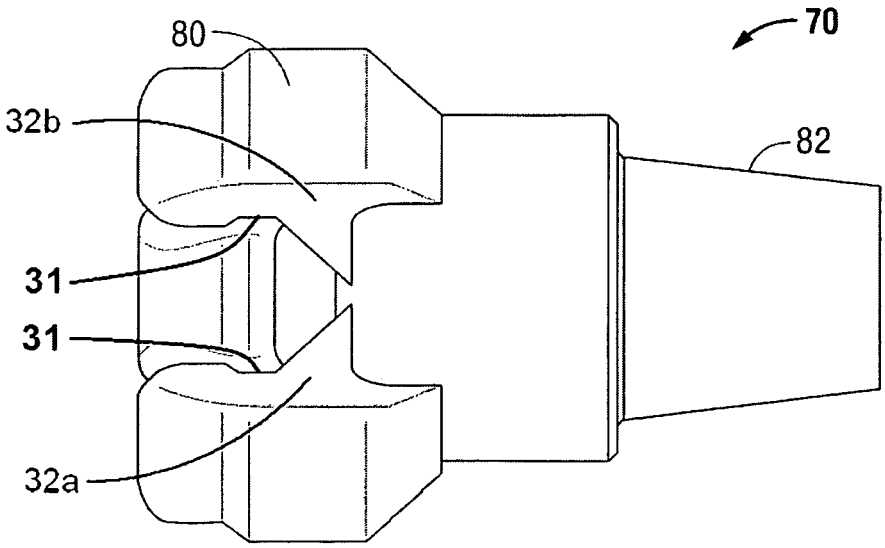
FIG. 2B is a side view of the drill bit according to FIG. 2A.
Figure 2C:
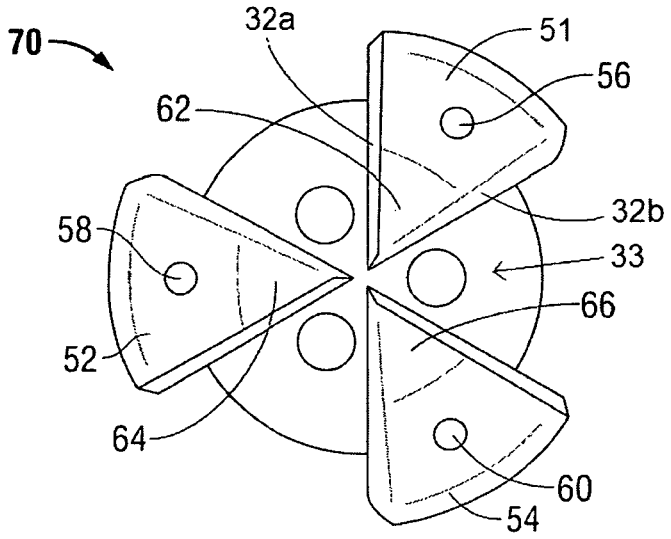
FIG. 2C is a bottom end view of the drill bit according to FIG. 2A.
Figure 3A:
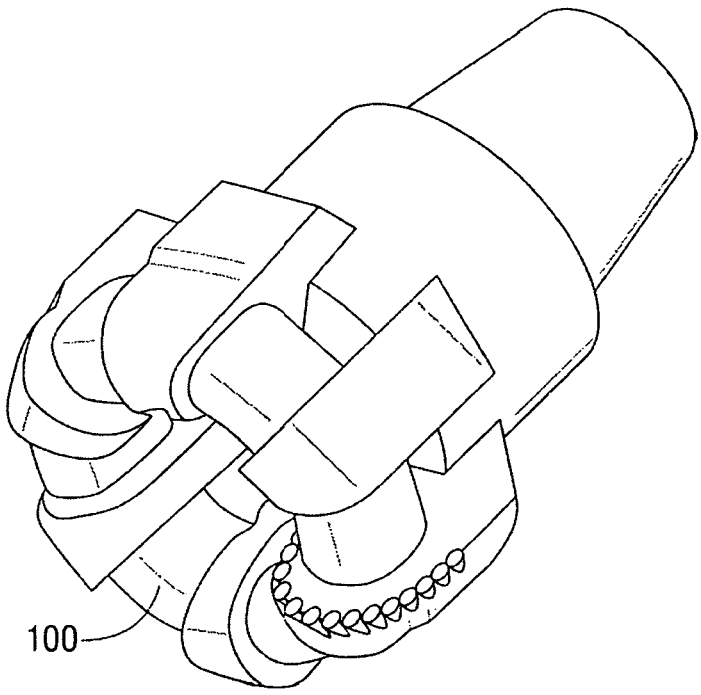
FIG. 3A is an elevated, isometric, pictorial view of a six bladed drill bit having a webbing or ring support between the blades according to the invention.
Figure 3B:
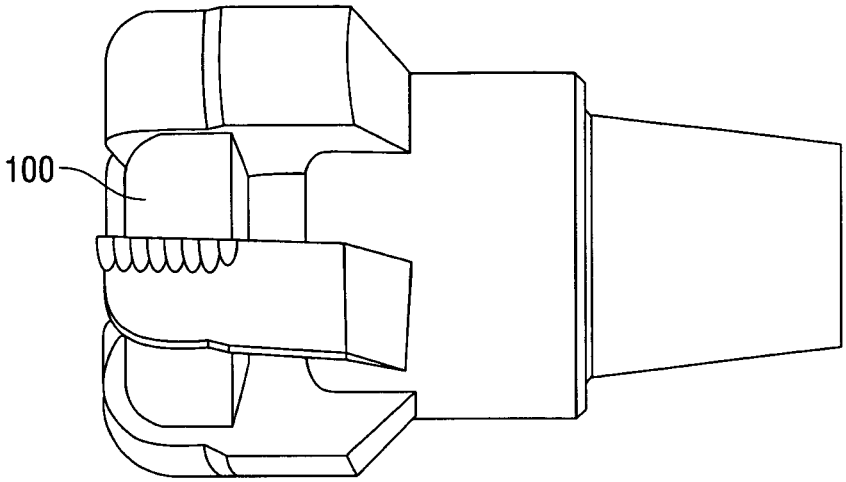
FIG. 3B is a side view of the drill bit according to FIG. 3A.
Figure 3C:
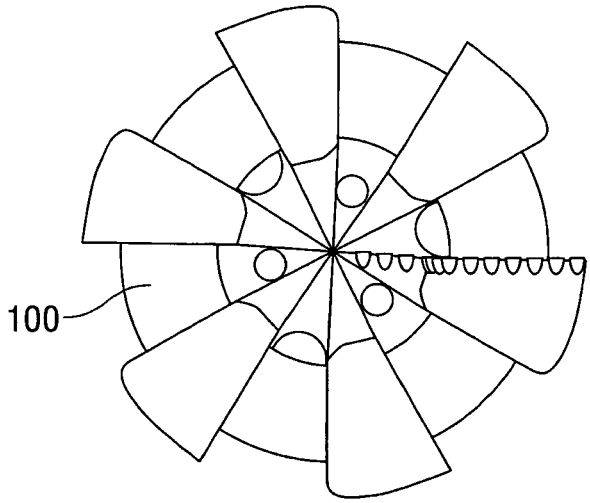
FIG. 3C is a bottom view of the drill bit according to FIG. 3A.
Figure 3D:
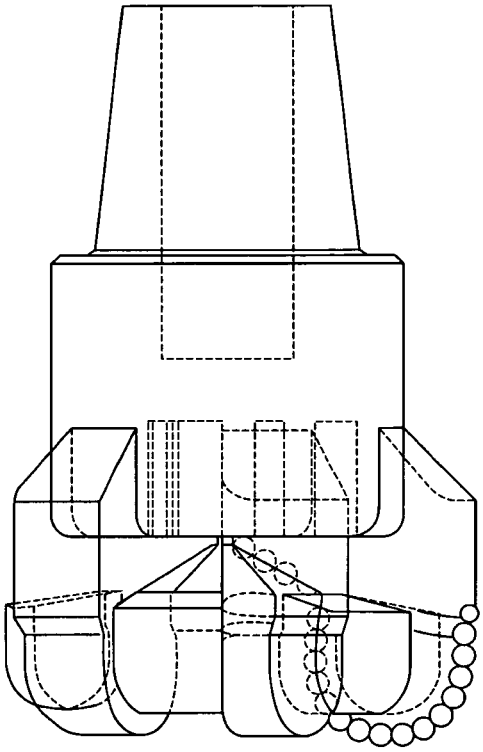
FIG. 3D is an elevated, pictorial view, partly in cross-section, of the drill bit according to FIG. 3A.

Referring now to FIGS. 2A, 2B and 2C, there is illustrated a lug designed PDC drill bit having three lugs 50, 52 and 54. Each of the blades is further shown comprising a side surface 32*a* and 32*b*, which defines an open space or a channel 33 therebetween. In accordance with the present invention, the bit 70 has its own nozzles 56, 58 and 60 which enable drilling mud to exit close to the PDC cutters, respectively, in the relief areas 62, 64 and 66. The PDC drill bit 70 illustrated in FIGS. 2A, 2B and 2C each has a row of PDC cutters and the lugs 50, 52 and 54, as well as PDC cutters in the relief surfaces 62, 64 and 66. The PDC drill bits 70, the lugs 50, 52 and 54 each has a wear gauge pad 80 which assists in keeping the drill bit in gauge in drilling the earth borehole. The PDC drill bits 70 also has a threaded pin end 82 for threadedly connecting into the box end of a joint drill pipe (not illustrated).

In operation of the drill bit of drill bit 70, it is very much like the operation of the embodiment of FIG. 1A-1D in that the cutters on the lugs 51, 52 and 54 form the core stump and then the cutters on the relief portion 62, 64 and 66 cause the stress concentrations to be formed around the upper periphery of the stump and during which, the PDC cutters in the relief portion 62, 64 and 66 can easily drill the core stump out of the way.

FIGS. 3A, 3B, 3C and 3D function much the same as the drill bit illustrated in FIGS. 1A, 1B, 1C and 1D, other than for the optional webbing or ring 100 which provides mechanical supports for the six (6) blades.

Figure 6:
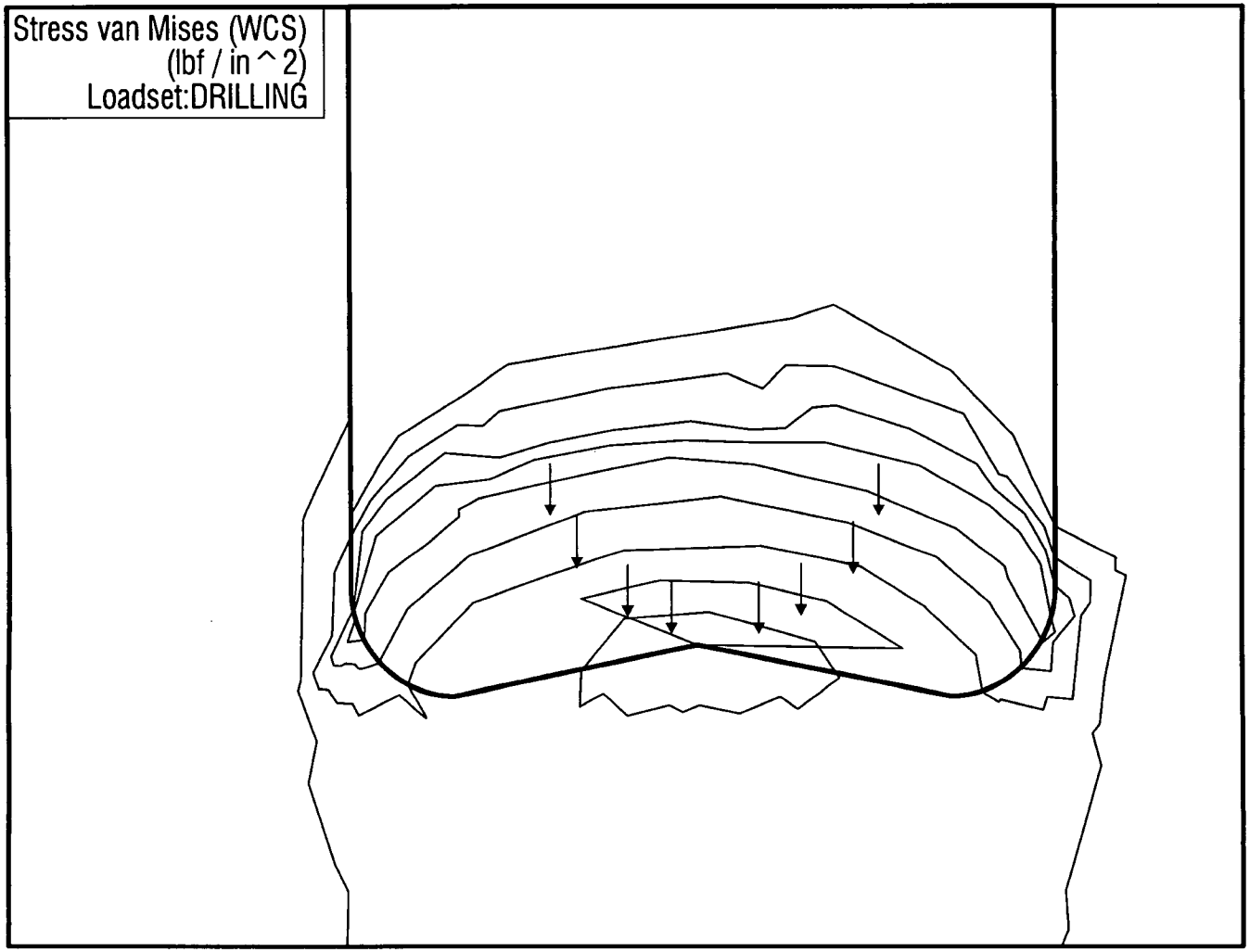
FIG. 6 is an elevated, schematic view of the stress concentrations resulting in the rock formations from using a conventional PDC drill bit known in the prior art.

Referring now to FIG. 6, there is illustrated stress concentrations from the use of a prior art PDC drill bit in which the stress concentrations are all towards the lower end of the bore hole but are not concentrated as described herein in accordance with the invention.

Figure 4:
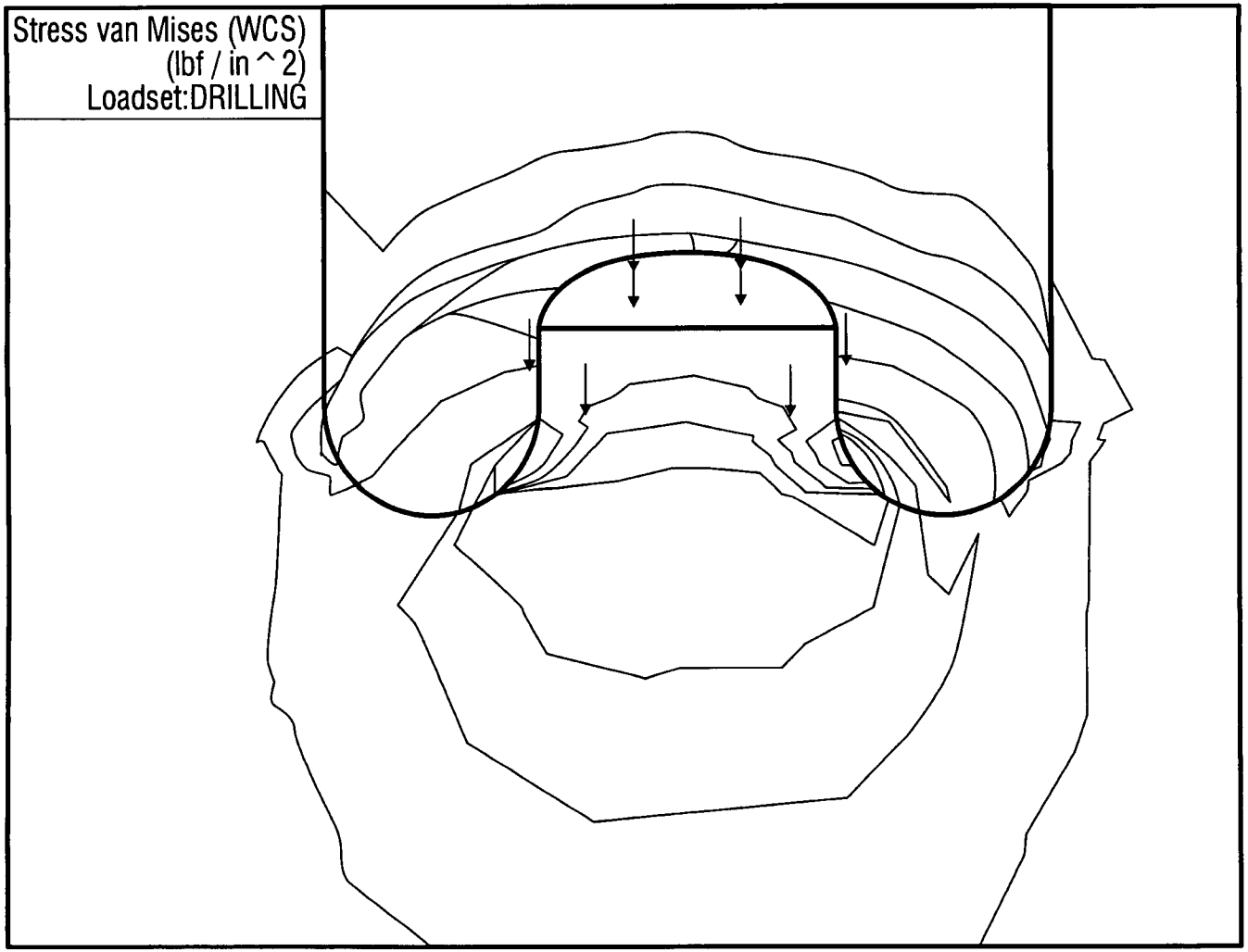
FIG. 4 is an elevated schematic view of the stress concentrations around the lower periphery of the core stump produced by the drill bit according to the invention.

Referring now to FIG. 4, there is illustrated a schematic view of the stress forces according to the present invention wherein the top of the core is a dome shape resulting from the curvatures of the cutters 29 illustrated in FIG. 1D resulting from the cutters 29 being forced against the top of the core, thus causing the stress concentration around the upper periphery of the core stump. This causes any forces created by the cutters 29 to cause the stump to rupture and be easily drilled out.

Figure 5:
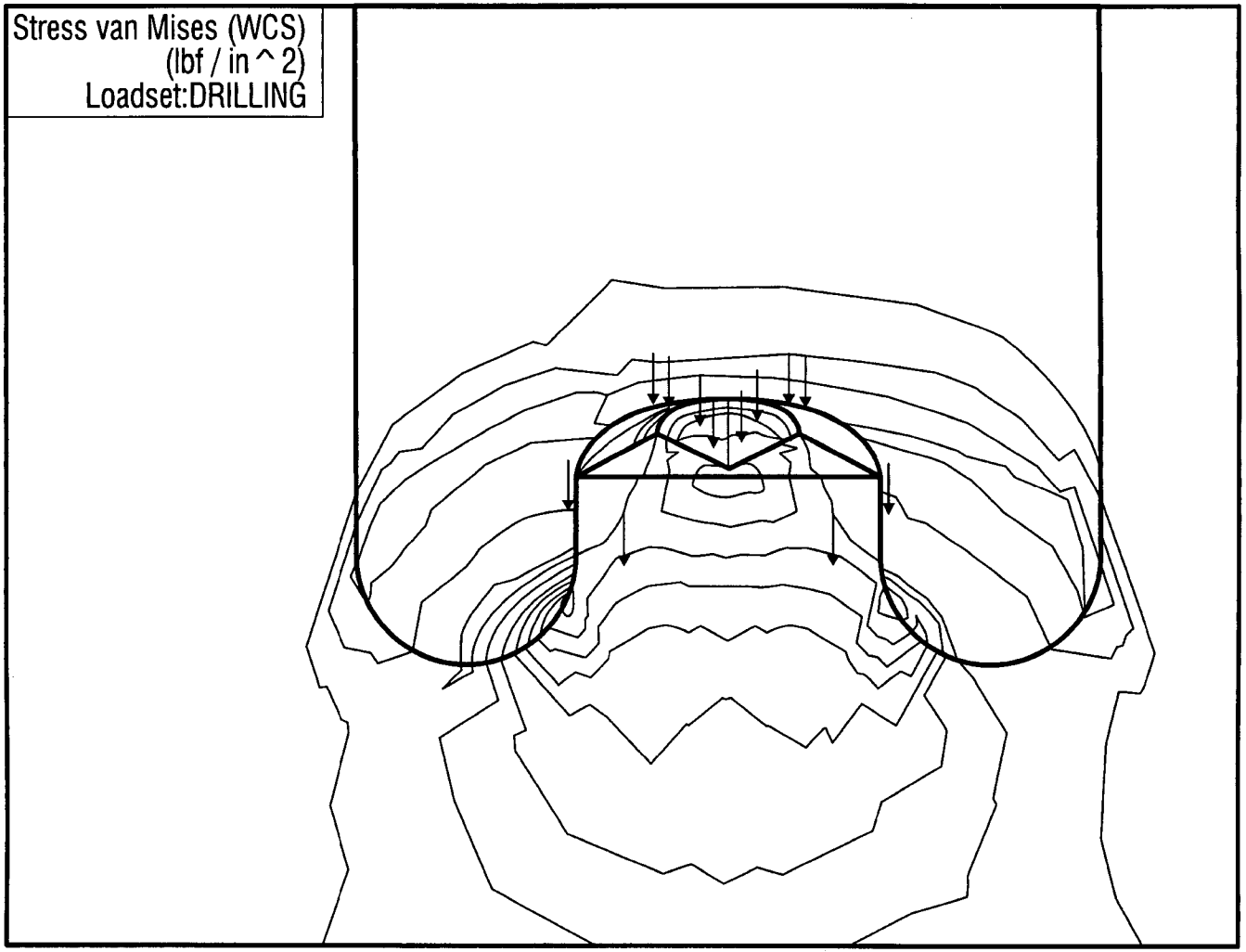
FIG. 5 is an elevated, schematic view of the stress concentrations around the lower periphery of the core stump produced by the drill bit having a frustum at the midline of the drill bit according to the invention.

FIG. 5 illustrates an alternative embodiment of the invention where, in aiding the drilling the of core stump, a frustum is used at the top of the dome which further concentrates the stresses around the periphery of the upper end of the core stump, thus enabling the rupture of the core stump and the faster drilling out the core stump as contemplated by this invention.

What is claimed is:

1. A fixed cutter, polycrystalline diamond compact drill bit for drilling oil and gas wells, comprising:

a carbide matrix bit body having a male threaded end and blades at a second end of said bit body, each of said blades having a first plurality of polycrystalline diamond compact cutters mounted therein, said blades being spaced from each other such that the rotation of the drill bit causes a cutout into the earth formation while leaving a core stump in the center of a drilled borehole, a second plurality of polycrystalline diamond compact cutters attached to said blades in a recessed region above the first plurality of polycrystalline diamond compact cutters, wherein each of said blades is separated from an adjacent blade by a space therebetween, wherein the space radially extends through the entire radial width of the blades adjacent the first plurality of polycrystalline diamond compact cutters, wherein the space radially extends through the entire radial width of the blades adjacent the second plurality of polycrystalline diamond compact cutters, wherein each of said blades further comprises an inner gauge relief for enabling freestanding of the core stump unsupported by said blades, and wherein the second plurality of polycrystalline diamond compact cutters contact a top surface of the core stump to thereby increase stress concentrations in the periphery of the core stump and thereby rupture and facilitate the drilling of the core stump.

2. The drill bit according to claim 1, wherein said plurality of blades each has a respective gauge pad associated therewith and one end of the first plurality of polycrystalline diamond compact cutters is in close proximity to the respective gauge pad, and wherein an inner gauge region is disposed between the second plurality of polycrystalline diamond compact cutters and the first plurality of polycrystalline diamond compact cutters, wherein said inner gauge relief is defined by a lateral groove extending along an inner surface of said blades, wherein the lateral groove extends along an entire width of said blades.

3. The drill bit according to claim 1, wherein the recessed region comprises a convex frustum oriented to further increase the stress concentrations in the core stump to facilitate drilling of the core stump, wherein the convex frustum is convex in the downwell direction, wherein the convex frustum is positioned at a midline of the drill bit, and wherein the convex frustum is adapted to rupture the core stump.

4. The drill bit according to claim 1, wherein portions of the blades comprising the first and second pluralities of polycrystalline diamond compact cutters comprise side surfaces extending radially along the entire radial width of the blades, wherein the side surfaces define the space extending between adjacent blades.

5. The drill bit of claim 1, further comprising at least one fluid port positioned between the blades adjacent to the second plurality of polycrystalline diamond compact cutters and at least one fluid port positioned on the blades adjacent to the first plurality of polycrystalline diamond compact cutters.

6. A method for facilitating drilling of a borehole in hard rock, comprising:

providing a drill bit comprising a plurality of blades;

drilling a borehole with a first plurality of polycrystalline diamond compact cutters positioned on each blade of the plurality of blades while leaving a freestanding core stump;

pressing against the top end of the freestanding core stump with a second plurality of polycrystalline diamond compact cutters positioned on each blade of the plurality of blades and oriented to concentrate stresses in a periphery of the core stump, wherein the plurality of blades are separated by a space therebetween, wherein the space radially extends through the entire radial width of the blades adjacent the first plurality of polycrystalline diamond compact cutters, wherein the space radially extends through the entire radial width of the blades adjacent the second plurality of polycrystalline diamond compact cutters, wherein an inner gauge region is disposed between the second plurality of polycrystalline diamond compact cutters and the first plurality of polycrystalline diamond compact cutters, wherein an inner gauge relief is defined within the inner gauge region for enabling freestanding of the core stump unsupported by the inner gauge region, and wherein drilling the borehole comprises rotation of the first and second pluralities of polycrystalline diamond compact cutters about a single axis; and rupturing and drilling out the freestanding core stump with said second plurality of polycrystalline diamond compact cutters while said stresses are concentrated therein.

7. The method according to claim 6, further comprising the step of pressing against a center of the core stump at the top end of the core stump using a convex frustum to further increase the stress concentrations therein and facilitate drilling of the core stump, wherein the convex frustum is convex in the downwell direction, thereby rupturing the core stump.

8. A drill bit for drilling oil and gas wells, the drill bit comprising:

a bit body and blades extending from the bit body at a downwell end of the drill bit, wherein the blades are detached from each other by a space therebetween, wherein the blades comprise a first plurality of cutter elements mounted thereon, wherein the downwell end of the drill bit further comprises a recessed region at a center of the drill bit between the blades, wherein the blades further comprise a second plurality of cutter elements mounted thereon at a top end of the recessed region, wherein the space radially extends through the entire radial width of the blades adjacent the first plurality of cutter elements, wherein the space radially extends through the entire radial width of the blades adjacent the second plurality of cutter elements, wherein an inner gauge region is disposed between the second plurality of cutter elements and the first plurality of cutter elements, wherein the inner gauge region comprises an inner gauge relief to cause operation of the drill bit to form a freestanding core stump within the recessed region, wherein the second plurality of cutter elements is oriented to increase stress concentrations in the periphery of the core stump to facilitate rupturing and drilling of the core stump, and wherein the first plurality of cutter elements and the second plurality of cutter elements are oriented in a fixed position relative to one another.

9. The drill bit according to claim 8, wherein the recessed region comprises a convex frustum oriented to further increase the stress concentrations in the freestanding core stump to facilitate drilling of the freestanding core stump, wherein the convex frustum is convex in the downwell direction, and wherein the convex frustum comprises a symmetrical configuration and is centrally positioned within the recessed region.

10. The drill bit of claim 8, wherein the blades protrude from the bit body and converge toward an axis of rotation of the drill bit at the top end of the recessed region, wherein the second pluralities of cutter elements are mounted on the blades.

11. The drill bit of claim 8, wherein the inner gauge relief comprises a channel extending laterally along the lateral width of the blades along the inner surface of the blades.

12. A drill bit for drilling wells, comprising:

a body having a front end in a direction of drilling and an axis of rotation;

a plurality of blades protruding from the front end of the body along the axis of rotation, wherein each blade of the plurality of blades is spaced from the axis of rotation, wherein each blade of the plurality of blades comprises an inside surface facing the axis of rotation to define a cavity between the plurality of blades, wherein each blade of the plurality of blades comprises an inner portion located proximate to the axis of rotation and an outer portion located farther from the axis of rotation than the inner portion, wherein the inner portion is located at an upper end of the cavity and the outer portion is located below the inner portion, wherein the plurality of blades are separated by a plurality of spaces, and wherein each space of the plurality of spaces radially extends through the entire radial width of each blade of the plurality of blades adjacent the inner portion and the outer portion of each blade of the plurality of blades; and a plurality of cutting elements attached along the outer portion and the inner portion of each blade of the plurality of blades.

13. The drill bit of claim 12, wherein a plurality of cutting elements attached to the outer portion of each blade enable cutting through rock while forming an uncut rock core in the cavity, wherein the plurality of cutting elements attached to the inner portion of each blade enable cutting of the uncut rock core located in the cavity, wherein the inner portions of each blade of the plurality of blades protrude from the front end of the body and converge towards the axis of rotation.

14. The drill bit of claim 12, further comprising a plurality of fluid ports in the body, wherein each fluid port of the plurality of fluid ports is located between the inner portions of the plurality of blades.

15. The drill bit of claim 12, wherein each blade of the plurality of blades comprises a lateral channel extending along the inside surface of each blade between the inner and the outer portions thereof, wherein each channel extends laterally along the entire lateral width of each blade.

16. The drill bit of claim 12, further comprising a convex frustum positioned at the axis of rotation, wherein the convex frustum comprises a symmetrical configuration with respect to the axis of rotation.

17. The drill bit of claim 12, wherein the plurality of cutting elements are attached along edges of the inner and the outer portions of the plurality of blades.

* * * * *